US008112962B2

(12) United States Patent
Bartley, II et al.

(10) Patent No.: US 8,112,962 B2
(45) **Date of Patent: *Feb. 14, 2012**

(54) GRATING SYSTEM WITH ENHANCED SEE-THROUGH CHARACTERISTICS

(75) Inventors: David W. Bartley, II, North Canton, OH (US); Kenneth P. Apperson, Canton, OH (US)

(73) Assignee: Ohio Gratings, Inc., Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/180,057

(22) Filed: Jul. 11, 2011

(65) Prior Publication Data

US 2011/0268500 A1 Nov. 3, 2011

Related U.S. Application Data

(63) Continuation of application No. 12/971,711, filed on Dec. 17, 2010, now Pat. No. 8,011,157, which is a continuation-in-part of application No. 12/887,105, filed on Sep. 21, 2010, now Pat. No. 7,918,067, which is a continuation of application No. 12/316,206, filed on Dec. 10, 2008, now Pat. No. 7,832,172.

(51) Int. Cl.
*E04C 2/42* (2006.01)

(52) U.S. Cl. ..... 52/664; 52/653.1; 52/668; 52/669; 52/660

(58) Field of Classification Search ..... 52/664, 52/653.1, 668, 660, 669, 673, 650.3, 661, 52/663, 666; 402/2; 404/2; 405/36, 39, 405/40, 41, 42, 52, 125, 127; 210/163–166
See application file for complete search history.

(56) References Cited

U.S. PATENT DOCUMENTS

| | | | | |
|---|---|---|---|---|
| 1,214,928 | A | | 2/1917 | Lachman |
| 2,509,732 | A | | 5/1950 | Ernestus |
| 2,645,985 | A | | 7/1953 | Beebe et al. |
| 2,767,627 | A | * | 10/1956 | Lynn ..... 52/668 |
| 2,834,267 | A | | 5/1958 | Beebe |
| 2,952,905 | A | * | 9/1960 | Lorig ..... 29/897.15 |
| 3,045,576 | A | * | 7/1962 | Goettl ..... 454/314 |
| 3,881,832 | A | | 5/1975 | Maguire |
| 4,046,482 | A | | 9/1977 | Paasch |
| 4,409,770 | A | | 10/1983 | Kawaguchi et al. |
| 4,661,245 | A | | 4/1987 | Rutherford et al. |
| 4,761,930 | A | | 8/1988 | Tepera |
| 4,897,299 | A | | 1/1990 | Kawachi et al. |
| 5,291,714 | A | * | 3/1994 | Wright et al. ..... 52/664 |
| 5,463,786 | A | | 11/1995 | Mangone et al. |
| 5,733,445 | A | | 3/1998 | Fanelli |
| 5,864,910 | A | | 2/1999 | Mangone |
| 6,706,172 | B2 | | 3/2004 | Strawser, Sr. |
| 6,908,549 | B2 | | 6/2005 | Middleton et al. |
| 7,393,153 | B2 | | 7/2008 | Woodson et al. |

* cited by examiner

*Primary Examiner* — William Gilbert
*Assistant Examiner* — Patrick Maestri
(74) *Attorney, Agent, or Firm* — Sand & Sebolt

(57) ABSTRACT

A grating system provides enhanced see through characteristics and typically includes longitudinal deep bars, axial crossbars, axial filler bars between the crossbars and longitudinal joining bars which join the crossbars and filler bars to one another. The deep bars are part of a first subassembly and the other bars are part of a second subassembly which may be lowered to join the two subassemblies to one another. The crossbars and filler bars are typically seated on the deep bars. The joining bars are typically above and aligned with the deep bars. The upper surfaces of the crossbars and filler bars are usually substantially flush with one another. The grating system is configured to support vehicular and pedestrian traffic.

20 Claims, 13 Drawing Sheets

GRATING SYSTEM WITH ENHANCED SEE-THROUGH CHARACTERISTICS

CROSS REFERENCE TO RELATED APPLICATIONS

This application is a continuation of U.S. application Ser. No. 12/971,711 filed Dec. 17, 2010; which is a continuation-in-part of U.S. application Ser. No. 12/887,105, filed Sep. 21, 2010 (now U.S. Pat. No. 7,918,067), which is a continuation of U.S. patent application Ser. No. 12/316,206, filed Dec. 10, 2008 (now U.S. Pat. No. 7,832,172); the disclosures of which are incorporated herein by reference.

BACKGROUND OF THE INVENTION

1. Technical Field

The present invention relates generally to grates and grating systems. More particularly, the invention relates to a grating assembly which is typically suitable to accommodate both vehicle traffic and pedestrian traffic. Specifically, the invention relates to such a grating assembly configured to provide enhanced see through characteristics to increase the visibility of items below the grating assembly.

2. Background Information

A host of grating assemblies are known in the art, some of which have a suitable strength for supporting vehicle traffic while also being configured to accommodate pedestrian traffic. More particularly, these grating assemblies are configured to accommodate wheelchairs without the risk of having the wheels become stuck between bars of the grate, as well as accommodating walking canes and the spikes of high heeled shoes without presenting a similar problem. An example of such a grating system is disclosed in U.S. Pat. No. 7,121,759 granted to Woodson et al., the contents of which are incorporated herein by reference. While the Woodson grating system works very well for its purpose, it does have some drawbacks, one of which is the use of welds along its upper surface, which detract from its aesthetic appeal. In addition, the Woodson grating system when used to form an overhead walkway or bridge tends to block a person's line of sight downwardly through the grating as the person walks or otherwise travels over it in a primary direction of travel so that items below the grate are not easily visible. More particularly, the Woodson deep bars or bearing bars are perpendicular to the primary direction of travel and form part of the upper surface of the grating whereby they provide good traction to foot traffic or vehicle traffic but also tend to block the downward view through the grating. The present grating system addresses these and other problems in the art.

BRIEF SUMMARY OF THE INVENTION

The present invention provides a grating assembly having longitudinal and axial directions comprising: a plurality of axially spaced longitudinal deep bars each having a top and bottom defining therebetween a first height; a plurality of longitudinally spaced axial crossbars each having a top and bottom defining therebetween a second height less than the first height; and a plurality of longitudinally spaced axial filler bars each having a top and bottom defining therebetween a third height which is less than the second height; wherein the deep bars are part of a first grating subassembly; the crossbars and filler bars are part of a second grating subassembly; the second subassembly has unjoined and joined positions in which it is respectively separate from and joined to the first subassembly; the second subassembly is movable downwardly from the unjoined position to the joined position where it rests on top of the first subassembly; the tops of the crossbars are substantially flush with the tops of the filler bars in the joined position; and a weld joins the first subassembly to the second subassembly in the joined position.

The present invention also provides a grating assembly having longitudinal and axial directions comprising: first, second and third axially spaced longitudinal deep bars each having a top and bottom defining therebetween a first height; wherein the second deep bar is between the first and third deep bars; a plurality of longitudinally spaced axial crossbars each seated on the deep bars and each having a top and bottom defining therebetween a second height less than the first height; wherein each crossbar has a first end disposed axially beyond the first deep bar in a first direction away from the second and third deep bars and a second end disposed axially beyond the third deep bar in a second opposed direction away from the first and second deep bars so that each crossbar extends continuously from the first end thereof to the second end thereof; and a plurality of longitudinally spaced axial filler bars each having a top and bottom defining therebetween a third height which is less than the second height; wherein the tops of the crossbars are substantially flush with the tops of the filler bars.

The present invention further provides a grating assembly having longitudinal and axial directions comprising: first, second and third axially spaced longitudinal deep bars each having a top and bottom defining therebetween a first height; wherein the second deep bar is between the first and third deep bars; a plurality of longitudinally spaced axial crossbars each seated on the deep bars and each having a top and bottom defining therebetween a second height less than the first height; and a plurality of longitudinally spaced axial filler bars each having a top and bottom defining therebetween a third height which is less than the second height; wherein each filler bar has a first end disposed axially beyond the first deep bar in a first direction away from the second and third deep bars and a second end disposed axially beyond the third deep bar in a second opposed direction away from the first and second deep bars so that each filler bar extends continuously from the first end thereof to the second end thereof; and the tops of the crossbars are substantially flush with the tops of the filler bars.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

FIG. 1 is a perspective view of the grating system of the present invention as it would appear installed in the ground or the like.

Similar numbers refer to similar parts throughout the drawings.

DETAILED DESCRIPTION OF THE INVENTION

Figure 1:
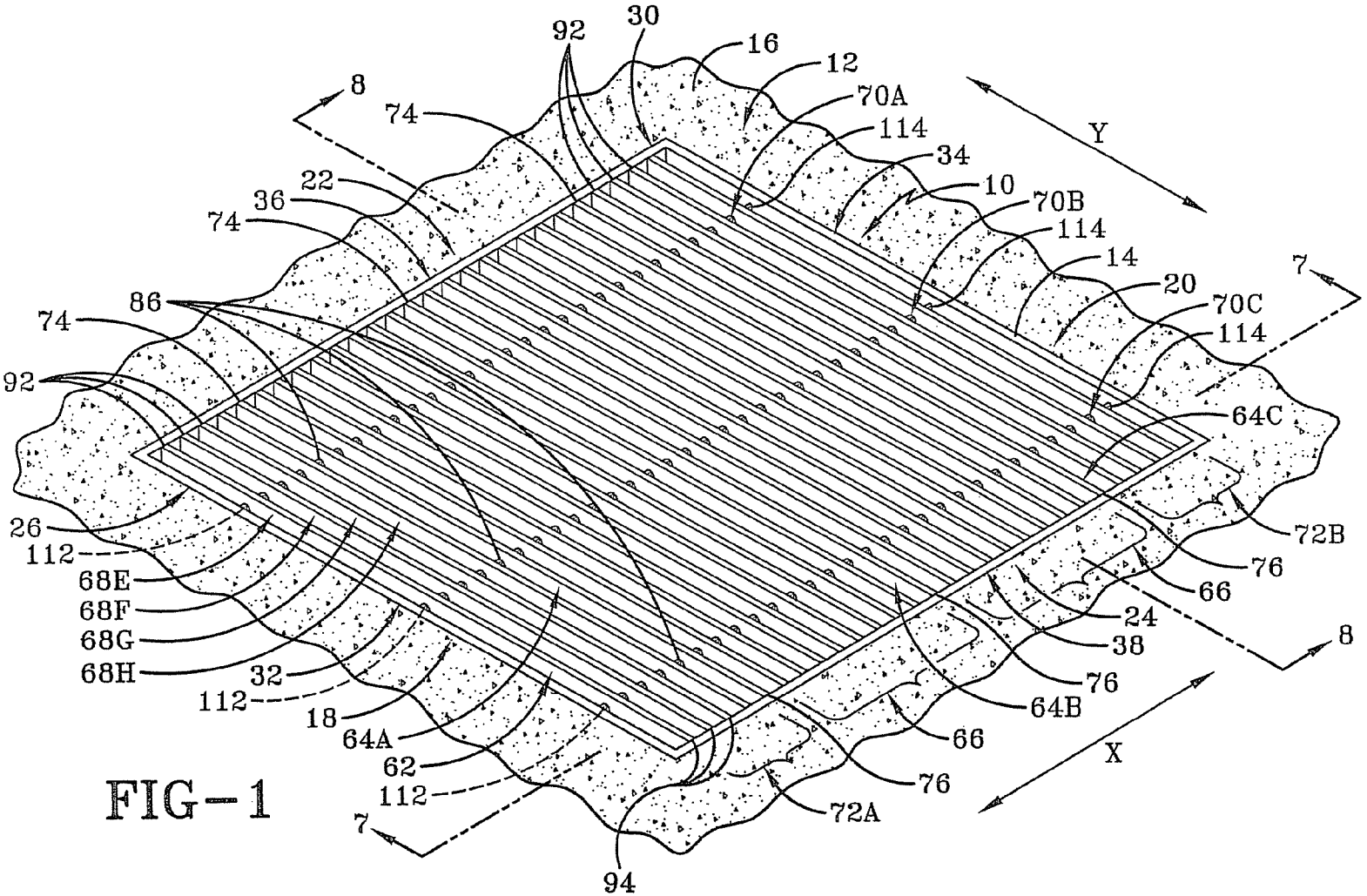

The grating assembly or system of the present invention is shown generally at 10 in FIG. 1 installed on a supporting structure 12 which often includes a bed of concrete or the like in which grating system 10 is embedded. Grating system 10 has an upper surface 14 which is substantially flush with or at the same height of an upper surface 16 of supporting structure 12. Upper surface 14 serves as a travel surface or contact surface which is contacted by pedestrian or vehicular traffic traveling over system 10. System 10 has first and second ends 18 and 20 defining therebetween a longitudinal direction (Arrow X) of the system which serves as the primary direction of travel of foot traffic or vehicular traffic along the upper surface of the grating. System 10 further includes first and second opposed sides 22 and 24 defining therebetween an axial direction (Arrow Y) of the system. Although system 10 is shown in FIG. 1 embedded in the ground, it may also be used to form an overhead walkway or bridge such that the improved see-through characteristics enhances a person's ability to see objects therebelow as they travel over the walkway or bridge in the primary direction of travel.

Figure 2:
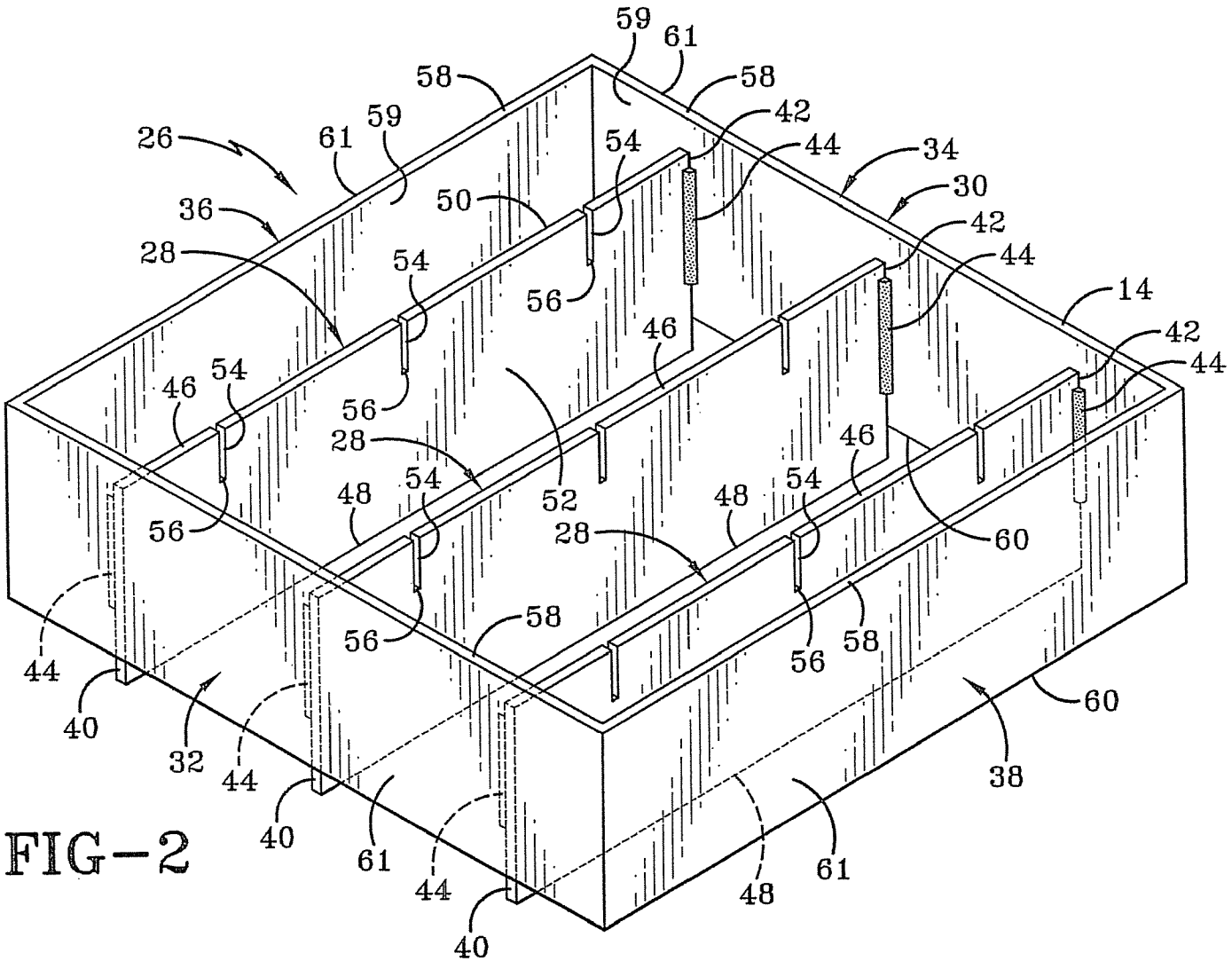
FIG. 2 is a perspective view of the lower subassembly of the grating system.
Figure 6:
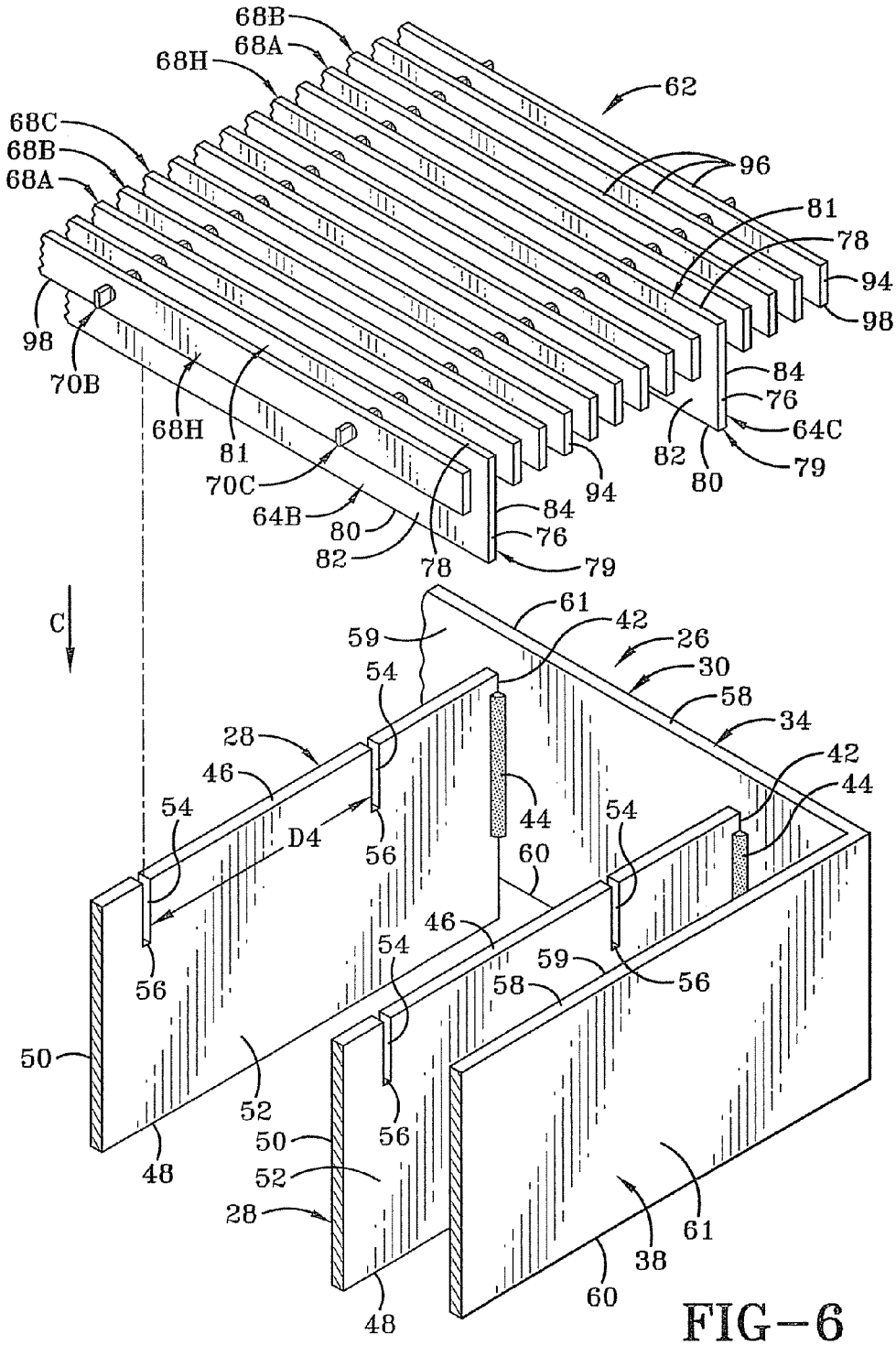
FIG. 6 is an exploded perspective view showing the section the upper grating subassembly aligned above a section of the lower grating subassembly prior to the joining of the two subassemblies.
Figure 7:
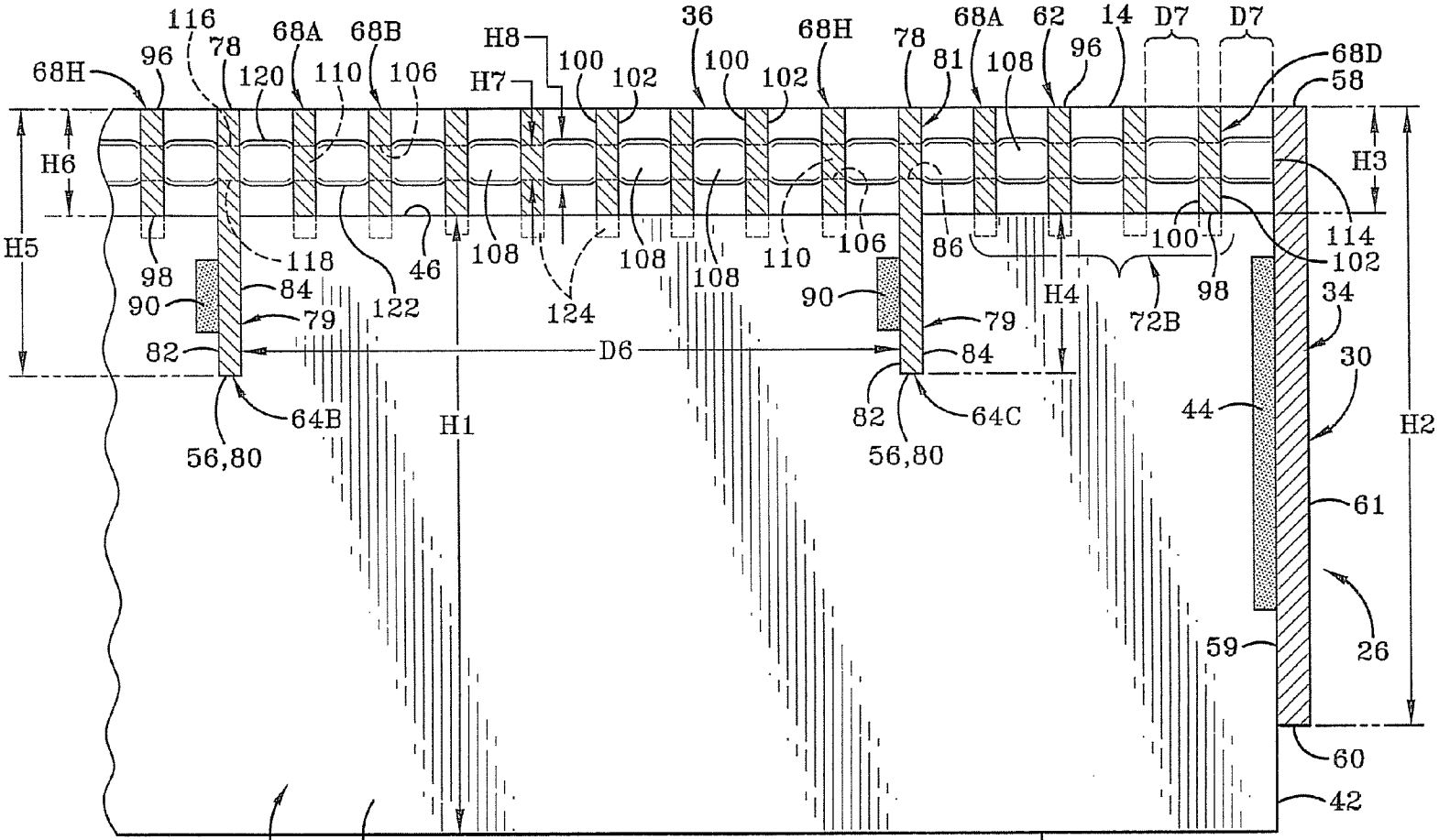
FIG. 7 is a sectional view taken on line 7-7 of FIG. 1.
Figure 8:
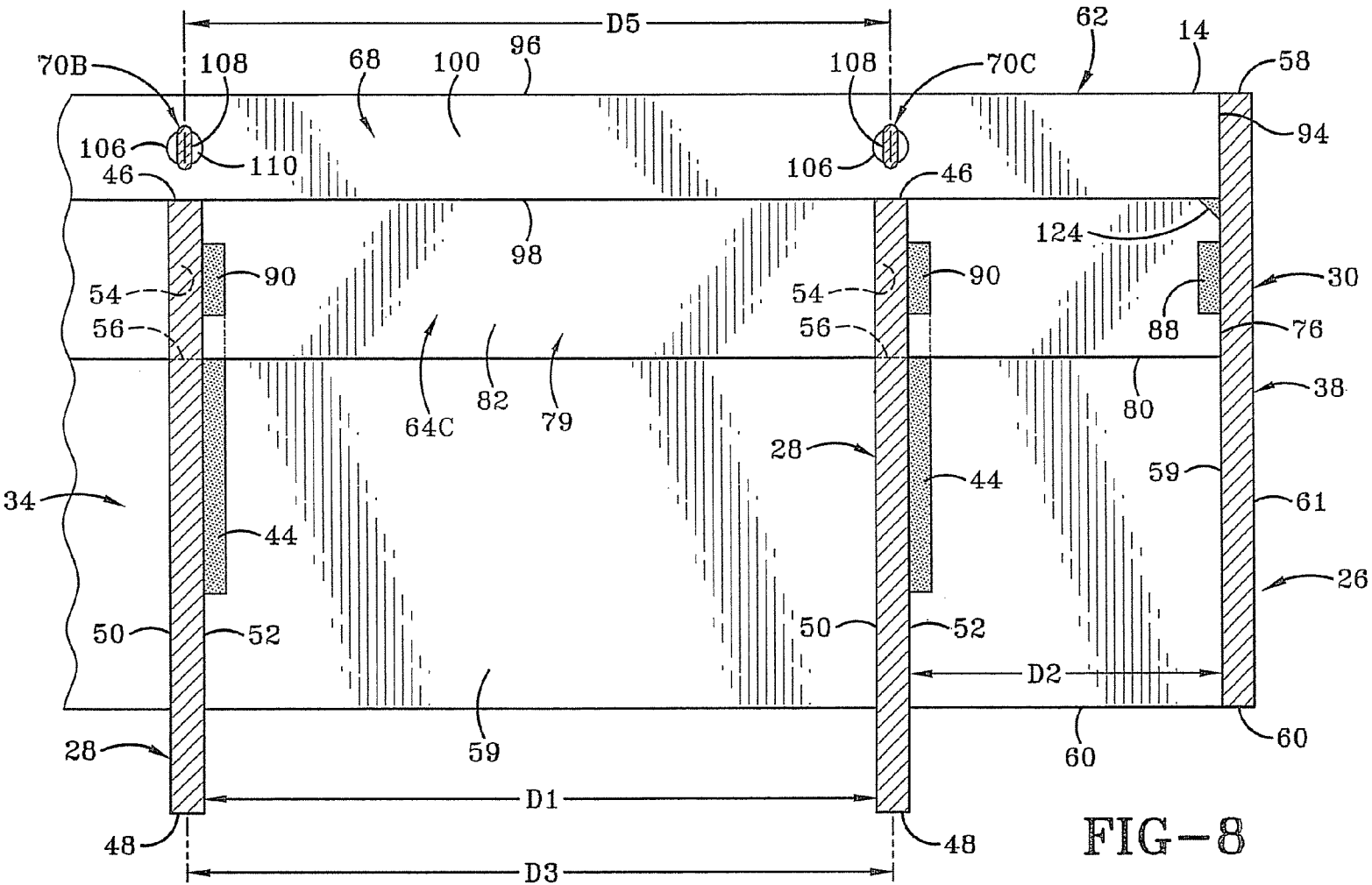
FIG. 8 is a sectional view taken on line 8-8 of FIG. 1.
Figure 9:
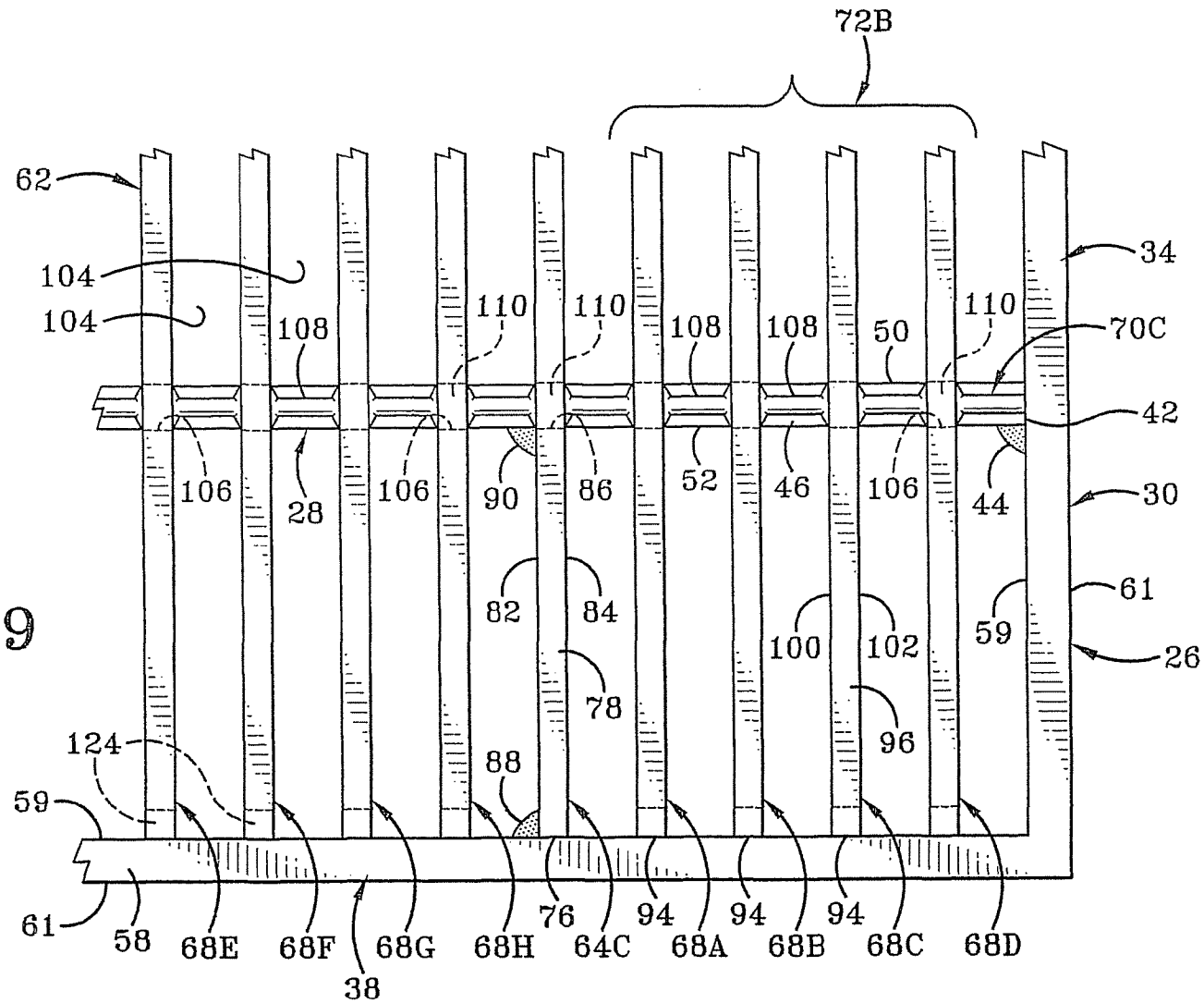
FIG. 9 is a top plan view of a corner section of the grating system.

Referring to FIG. 2, grating system 10 includes a rigid lower grating subassembly 26 comprising a plurality of longitudinal deep bars 28 which are typically axially evenly spaced from one another and rigidly mounted within a perimeter wall 30. Perimeter wall 30 includes first and second opposed typically parallel axial end bars 32 and 34, and first and second typically parallel longitudinal side bars 36 and 38 which extend perpendicularly between and are rigidly connected to end bars 32 and 34 to form respective corners of system 10. Deep bars 28 and perimeter wall 30 are each formed of a rigid material which is most typically a metal. Each deep bar 28 has first and second opposed ends 40 and 42 which are respectively rigidly secured to inner surfaces of first and second end bars 32 and 34, typically by respective welds 44. Each of deep bars 28 and end bars 32 and 34 are in the exemplary embodiment substantially straight elongated members which extend generally horizontally when assembled. Deep bars 28 are typically formed of a rigid plate of metal which is vertically oriented and has a top and bottom in the form of upper and lower ends or edges 46 and 48 defining there between a height H1 (FIG. 7) of deep bar 28. Height H1 in the exemplary embodiment is about 3.5 inches and typically within the range of about 2 to 8 inches. Deep bar 28 further includes flat and vertical first and second opposed sides 50 and 52 defining therebetween a thickness of deep bar 28 which in the exemplary embodiment is about 3/16 inch and typically is within the range of about 1/8 to 1/2 inch. A plurality of longitudinally spaced upwardly opening notches 54 is formed in each bar 28 extending from first side 50 to second side 52 and downwardly from top or upper edge 46 to a bottom upwardly facing seating surface 56 which bounds the respective notch 54. Top edge 46 and bottom surface 56 define therebetween a height H4 (FIG. 7) which is substantially less than height H1 and in the exemplary embodiment is less than 1/2 or even 1/3 of height H1. In the exemplary embodiment, height H4 is roughly 1/4 of height H1. Each of end bars 32 and 34 and side bars 36 and 38 has a respective upper and lower end or edge 58 and 60 defining therebetween a height H2 (FIG. 7) of the respective end bar or side bar. Height H2 in the exemplary embodiment is typically substantially the same as H1. Top surface or edge 58 forms part of upper surface 14 when assembly 10 is assembled. Each end bar and side bar has respective inner and outer opposed sides or surfaces 59 and 61 which are substantially vertical and define therebetween its respective thickness. In the exemplary embodiment, each side bar, end bar and deep bar also have substantially the same thickness. Upper edge 46 of deep bar 28 is spaced downwardly of upper edges 58 by a height H3 (FIG. 7) defined therebetween. Due to the fact that deep bars 28 in the exemplary embodiment have the same height as the ends bars and side bars, its bottom or lower edge 48 is likewise spaced downwardly of bottom or lower edge 60 by the same amount although this is not necessary since these heights could be different. Deep bars 28 extend generally in the same direction as one another and side bars 36 and 38, and in the exemplary embodiment each of deep bars 28 is parallel to one another and bars 36 and 38. Deep bars 28 extend transversely to end bars 32 and 34 and in the exemplary embodiment are perpendicular to said end bars. Each adjacent pair of deep bars 28 is spaced from one another so that the side 50 of one of the adjacent bars and the second side 52 of the other of the adjacent bars define therebetween a normal distance D1 (FIG. 8). Each of side bars 36 and 38 is spaced from the deep bar 28 which is respectively closest thereto so that the inner surface 59 of said side bar and one of surfaces 50 and 52 of said deep bar 28 define therebetween a normal distance D2 (FIG. 8) which is typically substantially less than distance D1. Each deep bar 28 has a centerline whereby adjacent pairs of these centerlines are axially spaced from one another a normal distance D3 (FIG. 8) which is slightly larger than distance D1 depending on the thickness of each deep bar and is typically equal to distance D1 plus the thickness of one deep bar 28. Distance D3 in the exemplary embodiment is about 4 inches although this may vary depending on the loading requirements. Each adjacent pair of notches 54 defines therebetween a normal distance D4 (FIG. 6).

Figure 3:
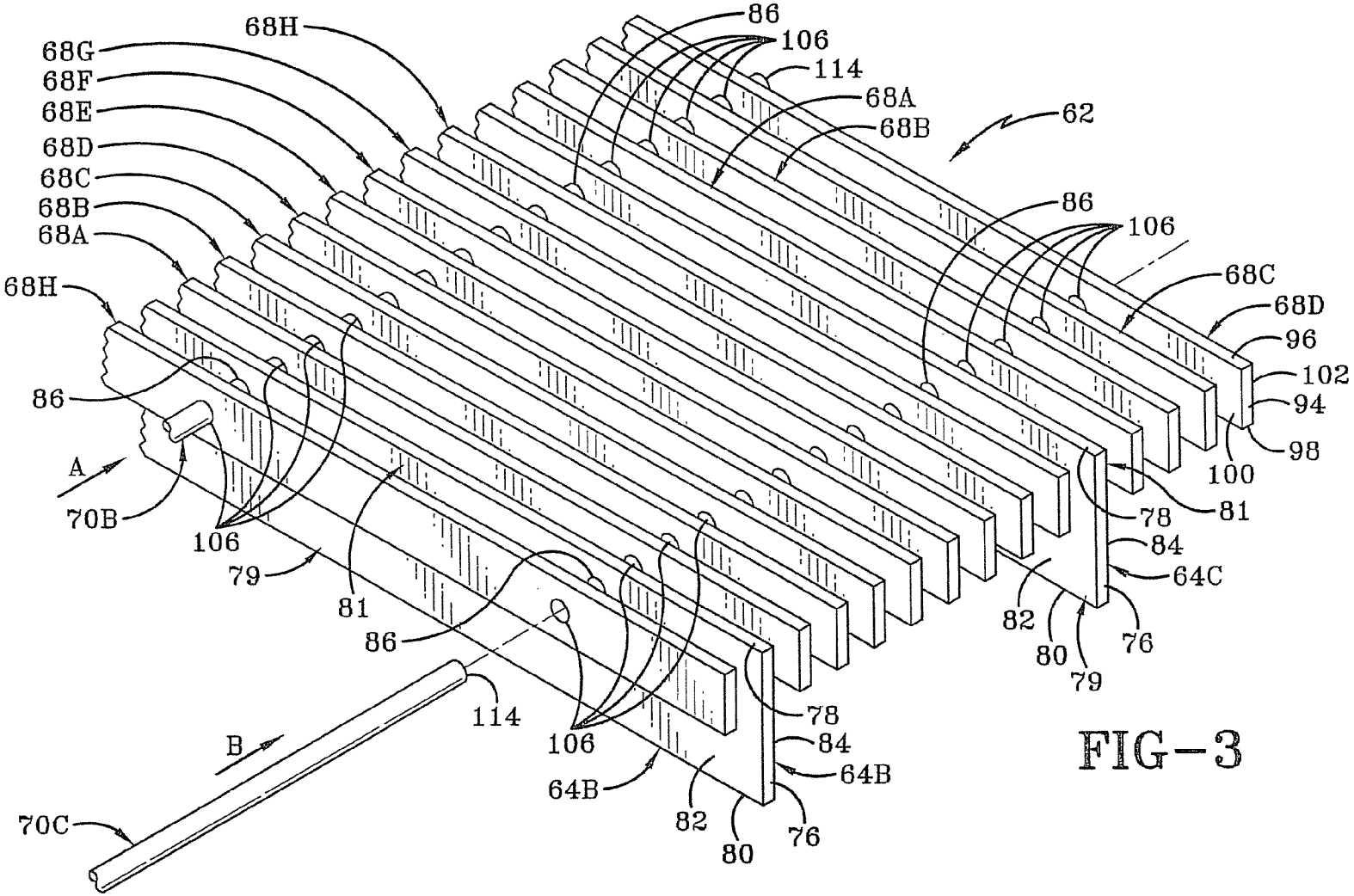
FIG. 3 is an exploded perspective view showing a section of the upper grating subassembly of the grating system in a partially assembled stage.
Figure 4:
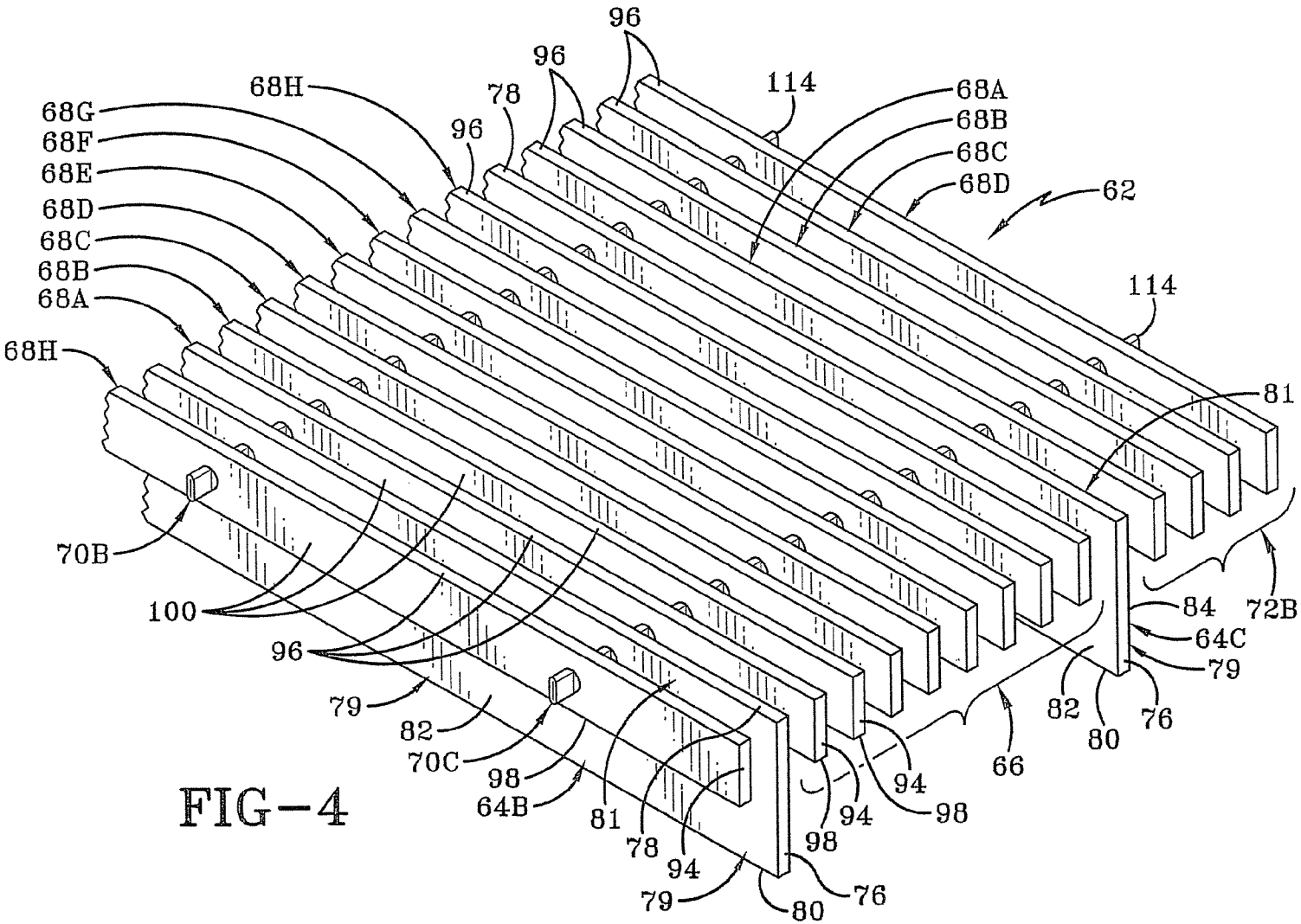
FIG. 4 is a perspective view of the section shown in FIG. 3 in its assembled form.
Figure 5:
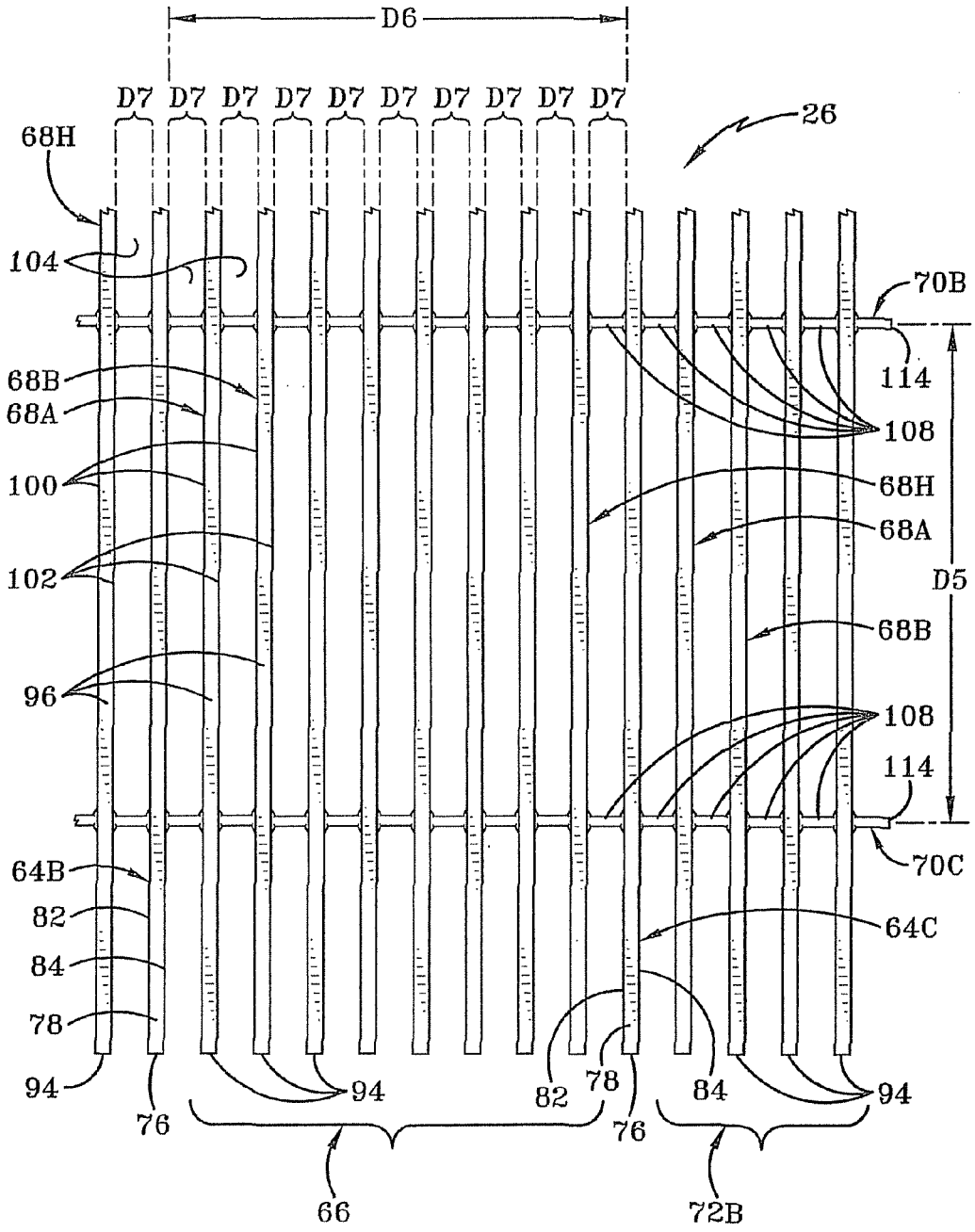
FIG. 5 is a top plan view of the section of the upper grating subassembly.

With primary reference to FIGS. 3-5, grating system 10 further includes a rigid upper grating subassembly 62 which is shown in a partially assembled configuration in FIG. 3 and a fully assembled configuration in FIGS. 4 and 5. Upper grating subassembly 62 includes three primary types of components, including a plurality of longitudinally spaced elongated members in the form of axial crossbars 64A-C all of which are shown in FIG. 1 and two of which of shown in FIGS. 3-5. Crossbars 64 extend generally in the same direction and in the exemplary embodiment are parallel to one another. Subassembly 62 further includes various sets 66 of longitudinally spaced elongated members in the form of substantially straight axial filler bars 68A-H which extend generally in the same direction and in the exemplary embodiment are parallel to one another and crossbars 64. Two full sets 66 are shown in FIG. 1 and one full set 66 is shown in FIGS. 3-5. Crossbars 64 and filler bars 68 extend transversely to deep bars 28 and in the exemplary embodiment are perpendicular to deep bars 28. Subassembly 62 further includes a plurality of elongated members in the form of substantially straight joining bars 70A-C, three of which are shown in FIG. 1 and two of which are shown in FIGS. 3-5. In addition, subassembly 62 includes partial or smaller end sets 72A and 72B of filler bars 68 respectively adjacent first end bar 32 and second end bar 34, both of which are shown in FIG. 1 and one of which is shown in FIGS. 3-5. Joining bars 70 extend generally in the same direction as one another and deep bars 28 and in the exemplary embodiment are parallel to one another and deep bars 28. Joining bars 70 are also transverse to crossbars 64 and filler bars 68 and in the exemplary embodiment are perpendicular thereto.

Each axial crossbar 64 has first and second opposed ends 74 (FIGS. 1) and 76 which are respectively closely adjacent or abutting the inner surfaces 59 of first and second side bars 36 and 38 when system 10 is assembled. Each crossbar 64 also includes an upwardly facing and typically horizontal top surface or edge 78 and a downwardly facing and typically horizontal bottom surface or edge 80 defining therebetween a height H5 (FIG. 7) which is substantially less than height H1 and in the exemplary embodiment less than ½ of height H1. Height H5 is in the exemplary embodiment about 1.5 inches and typically within the range of about 1 to 2 inches. Height H5 is greater than height H4 so that top edge 78 of each crossbar 64 is spaced upwardly of top edge 46 of each deep bar 28 when subassemblies 26 and 62 are joined. In the exemplary embodiment, height H5 is substantially equal to height H4 plus height H3. Top edge 78 forms a part of upper surface 14 (FIG. 1) when system 10 is assembled. Thus, when system 10 is assembled, each crossbar 64 includes a lower portion 79 which extends below upper edge 46 of deep bar 28 and is disposed within respective notch 54 in contact with deep bar 28. Each crossbar 64 thus further includes an upper portion 81 which extends upwardly from the top of the respective notch 54 above top edge 46 of deep bar 28. Each crossbar 64 has first and second opposed vertical sides 82 and 84 defining therebetween a thickness of crossbar 64 which is typically less than that of deep bars 28 and which in the exemplary embodiment is about ⅛ inch and typically within the range of about ⅛ to 3/16 inch. Crossbars 64 are typically formed of a heavy plate of metal and thus this thickness is relatively small and preferably slightly less than the width of the corresponding notch 54 so that crossbar 64 is easily lowered into notch 54 during assembly. Several sets of axially spaced through holes 86 are formed in crossbars 64 in the upper half thereof through extending from first side 82 to second side 84. FIG. 1 shows three sets of these holes and FIGS. 3 and 4 show two sets of these holes. Each adjacent set of holes 86 have centers which define therebetween a normal distance D5 (FIGS. 5, 8) which is substantially the same as distance D3 between the centers of adjacent deep bars 28. Each crossbar 64 may be rigidly secured adjacent respective ends 74 and 76 respectively to the inner surfaces of side bars 36 and 38 by end welds 88 when upper subassemblies 26 and 62 are joined to one another. Welds 88 are preferably spaced downwardly from upper surface 14. The respective sides or surfaces 82 and 84 of an adjacent pair of crossbars 64 define therebetween a normal distance D6 (FIGS. 5, 7) which is substantially the same as or slightly greater than distance D4 between notches 54 in deep bar 28. Crossbars 64 are typically joined to deep bars 28 at intersections therebetween by intermediate welds 90 between respective sides or side surfaces thereof. As shown in FIG. 7, welds 88 and 90 are positioned below filler bars 68 and downwardly of upper surface 46 of deep bars 28.

Each filler bar 68 has first and second opposed ends 92 and 94, as shown in FIG. 1. FIGS. 3-5 show second ends 94 only. Each filler bar 68 has an upwardly facing and typically horizontal top edge 96 and a downwardly facing typically horizontal bottom edge 98 defining therebetween a height H6 (FIG. 7) which is substantially equal to height H3. Height H3 and height H6 are in the exemplary embodiment about ½ inch and typically within the range of about ½ to 1.0 inch. It is noted that upper portion 81 of crossbar 64 has a height which is substantially equal to height H3 and height H6 and thus extends upwardly from top edge 46 of deep bar 28 so that top edge 78 of crossbar 64 is spaced upwardly from top edge 46 by the same height H3 or H6. Top edge 96 is substantially flush with edges 58 and 78 and forms part of upper surface 14 when system 10 is assembled. Each filler bar 68 has first and second vertical opposed sides 100 and 102 defining therebetween a thickness which is typically about the same as that of crossbars 64 and which is in the exemplary embodiment about ⅛ inch and typically within the range of about ⅛ to 3/16 inch. The first and second sides 100 and 102 of an adjacent pair of filler bars 68 define therebetween a distance D7 (FIG. 5) of a space 104. Distance D7 is in the exemplary embodiment about 5/16 inch and typically within the range of about ¼ to ½ inch. Typically, distance D7 is no more than ½ inch in order to stay within maximum guidelines of the Americans with Disabilities Act (ADA). Thus, each adjacent pair of filler bars 68 within a set 66 or a set 72 is equally spaced from one another. Each of crossbars 64 is positioned between two sets of filler bars 68 using the same spacing pattern. Thus for instance, first side 82 of crossbar 64B and second side 102 of the filler bar 68 which faces side 82 (the left most filler bar 68H in FIG. 5) also defines therebetween distance D7. By the way of further example, second side 84 of crossbar 64B and first side 100 of the filler bar 68 which faces and is adjacent crossbar 64B (filler bar 68A in FIG. 5) also defines therebetween distance D7. Thus, as a set, crossbars 64 and filler bars 68 in the exemplary embodiment are longitudinally equally spaced from one another. Preferably, there are multiple filler bars 68 within a given set 66 and in the exemplary embodiment, there are eight filler bars 68A-H within each set 66 while there are four filler bars 68 within each end set 72.

Several axially spaced sets of through holes 106 are formed in each filler bar 68 about midway between top and bottom edges 96 and 98 and extending from first side 100 to second side 102. These sets of holes 106 are respectively aligned with the sets of holes 86 formed in crossbars 64 to form several sets of combined holes 86 and 106 which respectively receive one of joining bars 70 therethrough. FIG. 3 shows joining bar 70B having been inserted or slid (arrow A) into one of these sets of holes 86 and 106 and another joining bar 70C external to another set of the holes 86 and 106 in preparation to be slid therethrough (arrow B) in the same manner as filler bar 70B.

Joining bars 70 have first and second opposed ends 112 and 114 which are respectively adjacent the inner surfaces of end bars 32 and 34 when grating system 10 is assembled, as shown in FIG. 1. During assembly of upper subassembly 62, crossbars 64 and filler bars 68 are held in the spaced relationship of the final product while each joining bar 70 is slid through the respective holes 86 and 106 to form respective intersections with crossbars 64 and filler bars 68. In the exemplary embodiment, each joining bar 70C is a hollow cylindrical tube which is formed of metal and swaged after it has been fully inserted in these holes in order to secure each of the crossbars 64 and filler bars 68 to one another in a manner to maintain their final spaced relationship with one another. More particularly, each joining bar 70 is deformed between each adjacent pair of filler bars and between each filler bar and the adjacent crossbar 64 to form deformed portions or segments 108 between the adjacent sets of bars to secure them in spaced relationship. The portion 110 of joining bars 70 within the various holes 86 and 106 remains substantially cylindrical. This process is described in greater detail in U.S. Pat. No. 7,121,759, which as previously noted is incorporated herein by reference. In the exemplary embodiment, each joining bar 70 is formed of a metal tube having an outer diameter within a range of about 3/16 to 5/16 inches with a wall thickness typically ranging from about 0.028 to about 0.065 inch prior to the swaging process. Portions 110 thus generally retain this corresponding outer diameter while segments 108 have a height which is greater than the corresponding outer diameter.

More particularly, each cylindrical portion 110 has a top 116 and bottom 118 defining therebetween a height H7 (the outer diameter) which is slightly smaller than the diameter of holes 86 and 106. Each deformed segment 108 has a top 120 and a bottom 122 defining there between a height H8 which is greater than height H7 and the diameter of holes 86 and 106. Top 120 is the uppermost portion of each joining bar 70 and is spaced downwardly from top edges 58, 78, and 96 whereby it is evident that each joining bar 70 in its entirety is positioned below these top edges. Most of the deformed segments 108 are positioned between an adjacent pair of filler bars 68 whereby these deformed segments 108 abut the respective facing surfaces or sides 100 and 102 of the respective adjacent pair of filler bars 68. Some of the deformed segments 108 are disposed between one of crossbars 64 and an adjacent filler bar 68 and likewise abut the facing sides thereof in order to secure the bars in the final spaced relationship with one another. Preferably, upper subassembly 62 is assembled without welding, as welding makes it more difficult to maintain the spacing between the crossbars and filler bars and also may detract from the appearance especially adjacent the upper surface of subassembly 62.

The assembly of grating system 10 is now further detailed with primary reference to FIGS. 6-9. FIG. 6 shows upper and lower subassemblies 62 and 26 each individually assembled and in an unjoined position in which the two subassemblies are separate from one another and more particularly with upper subassembly 62 positioned upwardly of lower subassembly 26. To join the two subassemblies, upper subassembly 62 is lowered vertically as a unit as indicated at Arrow C in FIG. 6, so that lower portions 79 of crossbars 64 are inserted into respective notches 54 of the various deep bars 28. Once subassembly 62 is fully lowered into position, bottom edges 80 of crossbars 64 are seated on the bottom seating surfaces 56 at the bottom of the respective notches 54. Similarly, the bottom edges 98 of the various filler bars 68 are seated atop top edges 46 of deep bars 28. Thus, top edges 78 of crossbars 64 and top edges 96 of filler bars 68 are positioned flush with or at the same height as top edge 58 of the outer perimeter wall 30. The lowermost portion 122 of joining bars 70 is spaced upwardly from the top edges 46 of deep bars 28 a short distance and thus are not in contact therewith. The opposed ends of crossbars 64 and filler bars 68 are positioned closely adjacent or in contact with the respective inner surfaces 59 of side bars 36 and 38. Likewise, opposed ends 112 and 114 of joining bars 70 are positioned closely adjacent or in contact with the inner surfaces 69 of the respective end bars 32 and 34. In addition, the filler bar 68 disposed closest to either end bar 32 or 34 is spaced therefrom by distance D7 (FIG. 7) in keeping with the spacing between the filler bars and crossbars. By way of example, FIG. 7 shows inner surface 59 of end bar 34 so spaced from side 102 of filler bar 68D of end set 72B. Most typically, joining bars 70 are not welded at their ends or otherwise fastened to end bars 32 and 34 although this may be done if desired. Upper and lower assemblies 62 and 26 are primarily joined to one another by welding, such as at welds 90 between crossbars 64 and deep bars 28 adjacent notches 54. The two subassemblies may also be joined by end welds 88 between the side bars 36 and 38 and the respective ends of crossbars 64. FIGS. 7 and 8 further show an additional end weld 124 between inner surface 59 of side bar 38 and each filler bar 68 adjacent end 94. Weld 124 is typically a tack weld extending from the bottom surface of filler bar 68 adjacent end 94 to inner surface 59 of side bar 38, and is usually substantially or entirely below said lower surface. Analogous end welds are typically formed between side bar 36 and the first ends 92 of filler bars 68. These various welds thus rigidly join upper and lower subassemblies 62 and 26 to one another to form grating system 10 as shown in FIG. 1. When subassemblies 26 and 28 are joined, joining bars 70 are respectively aligned with deep bars 28 directly above the respective top edges thereof and preferably do not extend outwardly in the axial direction beyond either side 50 or 52 of deep bar 28 in order to minimize any obstruction of visibility or line of sight downwardly through grating system 10.

Figure 10:
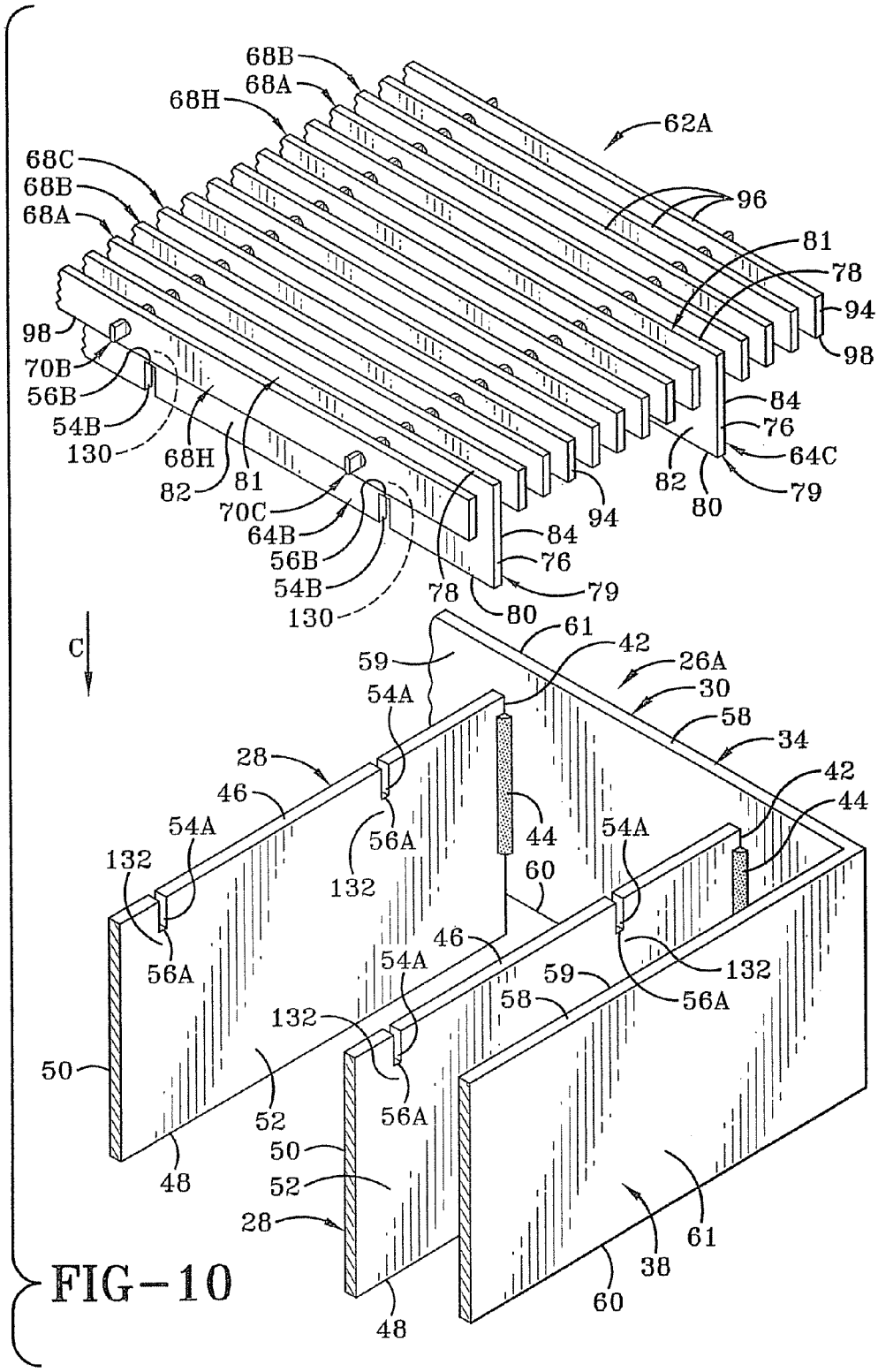
FIG. 10 is similar to FIG. 6 and shows the lower grating subassembly with modified notches in the deep bars and the upper grating subassembly with notches in the crossbars which align with the notches in the deep bars.
Figure 11:
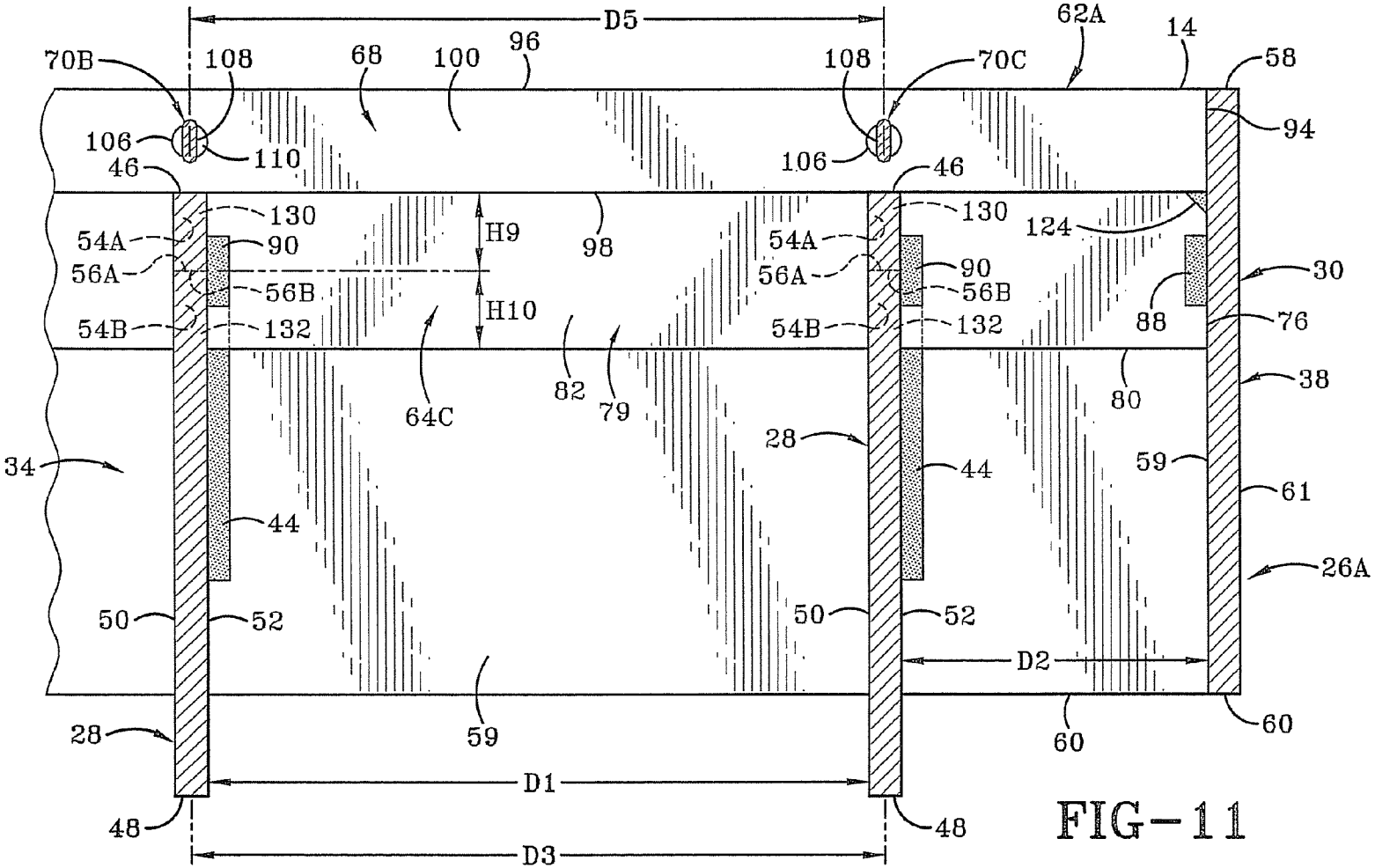
FIG. 11 is a sectional view which is similar to FIG. 8 and shows corresponding features related to the embodiment shown in FIG. 10.

Referring now to FIGS. 10 and 11, a grating assembly is illustrated which is very similar to that shown in the FIGS. 1-9 except that the grating assembly has been modified somewhat to include a lower grating assembly 26A in which the deep bars 28 are formed with longitudinally spaced upwardly opening notches 54A which are not as deep as notches 54 of the earlier embodiment, and to include an upper grating subassembly 62A in which the crossbars 64 are formed with axially spaced downwardly opening notches 54B which are respectively positioned to align with notches 54A. More particularly, notches 54A are spaced from one another in the same manner as notches 54 of the earlier embodiment, but are not as deep whereby each notch 54A has a typically horizontal bottom surface 56A whereby notch 54A extends from top surface 46 to bottom surface 56A along parallel vertical sides or side edges which define or bound the rectangular notch 54A. The downwardly opening notches 54B in crossbars 64 extend upwardly from bottom surface or edge 80 to a typically horizontal downwardly facing top surface 56B of the notch with vertical parallel sides extending therebetween to define the rectangular notch 54B. In the exemplary embodiment, each notch 54B is spaced downwardly from and directly below one of holes 106 formed in the same crossbar and the portion of the given joining bar 70 disposed within said hole 106. As shown in FIG. 11, top surface 46 and bottom surface 56A define therebetween a vertical height H9 of notch 54A which is substantially less than height H4 (FIG. 7) of notch 54, typically on the order of about one-half height H4 although this may vary. FIG. 11 also illustrates that bottom surface 80 and top surface 56A define therebetween a vertical height H10 of notch 54B which is also typically substantially less than height H4 and may be equal to height H9 although this may vary as well.

The joining of upper subassembly 62A to lower subassemblies 26A is similar to the joining of subassemblies 62 and 26 as previously described. However, instead of the bottom edge 80 of the given crossbar 64 being received within notch 54 of the earlier embodiment, upper subassembly 62A is lowered (arrows C in FIG. 10) from its unjoined position to the joined position shown in FIG. 11 such that a portion 130 of each crossbar 64 directly above notch 54B is received in notch 54A. Similarly, a portion 132 of deep bar 26 directly below each notch 54A is received within the corresponding notch 54B in crossbar 64 in the joined position. Thus, instead of the bottom edge 80 of crossbar being seated on the bottom surface 56 of deep bar 28 in the earlier embodiment, the crossbars are typically seated on the deep bars such that the top surface 56B of a given notch 54B is closely adjacent or seated on the bottom surface 56A of a given notch 54A. Other than using notches 54A and 54B in combination instead of using only the upwardly opening notches 54 of the earlier embodiment, all the other relationships previously described are likewise true of the embodiment shown in FIGS. 10 and 11. Thus, the upper and lower assemblies 62A and 26A are welded to one another such as at welds 44 and the various other components are arranged in the same fashion, such as end bars 32 and 34, side bars 36 and 38, filler bars 68 and joining bars 70, and each of these rigid bars, as with the other embodiments, is typically formed entirely of metal.

Figure 12:
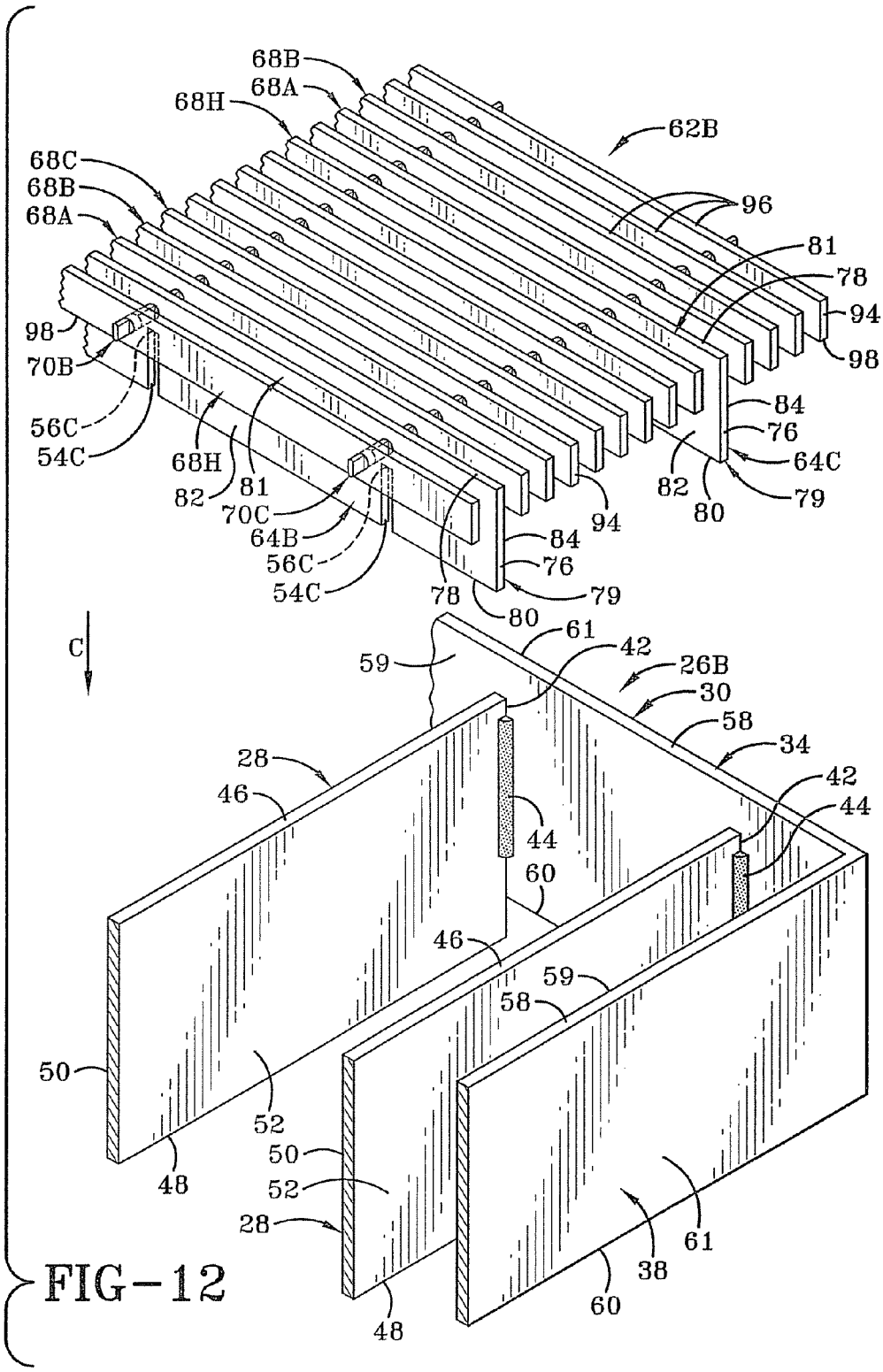
FIG. 12 is similar to FIG. 10 and shows the lower grating subassembly with deep bars which are free of notches and the upper grating subassembly with crossbars which include notches aligned to receive the deep bars.
Figure 13:
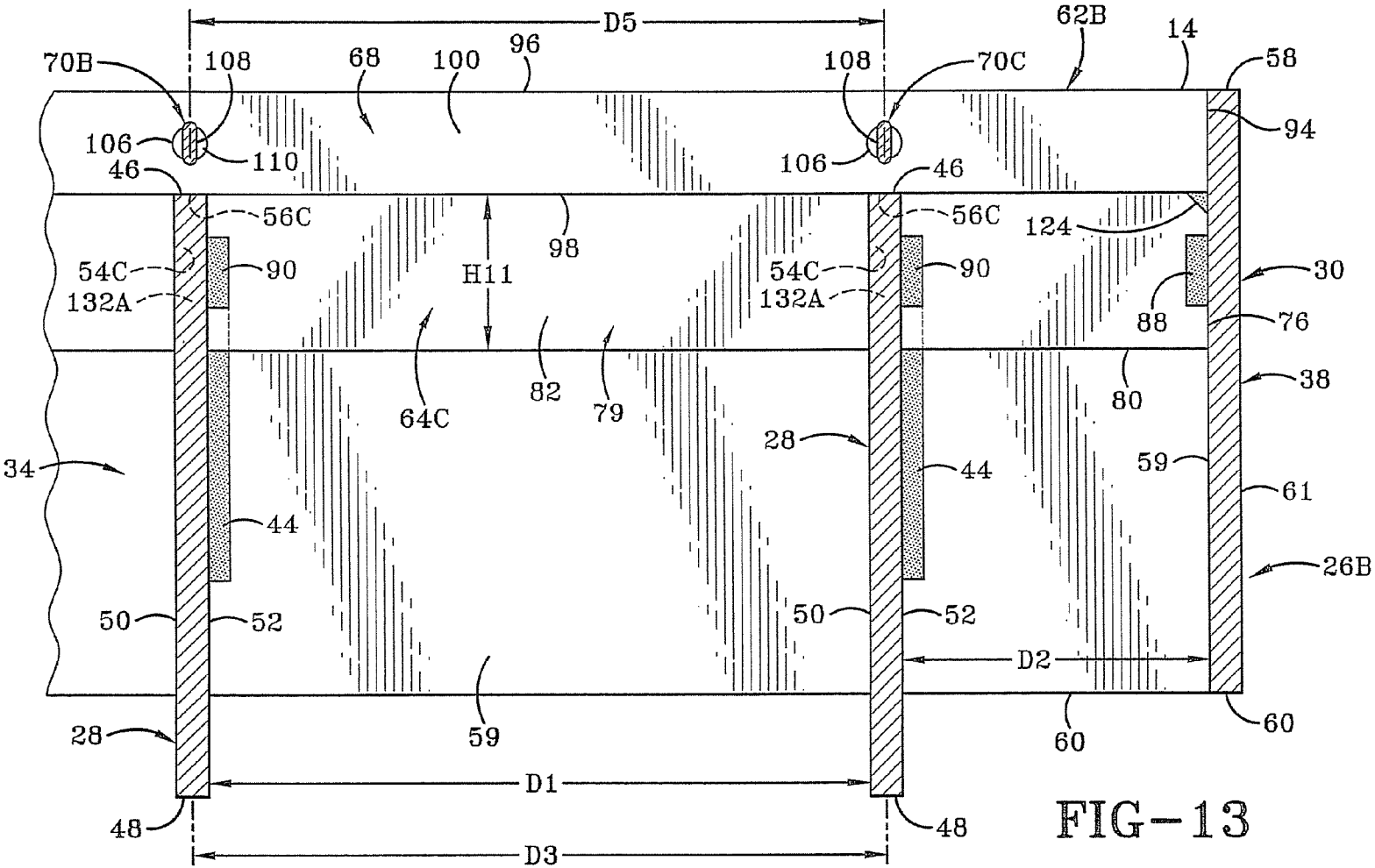
FIG. 13 is similar to FIG. 11 and illustrates the corresponding aspects of the embodiment shown in FIG. 12.

Referring now to FIGS. 12 and 13, the grating assembly of present invention is shown with an additional modification such that the grating assembly includes a lower grating subassembly 26B and upper grating subassembly 62B which are similar to their counterparts except that the deep bars 28 are formed without any upwardly opening notches for receiving the crossbars, and the crossbars 64 are formed with rectangular axially spaced downwardly opening notches 54C which receive portions 132A of deep bars 28 in the joined position shown in FIG. 13. Like notches 54B, downwardly opening notches 54C extend longitudinally from first side 82 to second side 84 and upwardly from bottom edge 80 to a typically horizontal downwardly facing top surface 56C of the notch along parallel vertical side edges of the notch. However, each notch 54C is deeper or of a greater height than the corresponding notches 54B. In the exemplary embodiment, bottom surface 80 of each crossbar 64 and top surface 56C of notch 54C define therebetween a vertical height H11 (FIG. 13) which in the exemplary embodiment is the same as height H4 (FIG. 7), as discussed earlier.

Like the previous embodiments, the embodiment shown in FIGS. 12 and 13 are permanently and rigidly joined or secured to one another by moving the upper subassembly 62B from its unjoined position of FIG. 12 to the joined position shown in FIG. 13, and welding the two subassemblies together such as at welds 44 as previously described. The only difference is that the portions 132A of the deep bar 28, which define a portion of top surface 46, are received within notches 54 as the upper subassembly moves downward, whereby the crossbars 64 are closely adjacent or seated on the deep bars via the top surface 56C being closely adjacent or seated on top surface 46. Top surface 56C of each notch 54C is at substantially the same height as the bottom surface or edge 98 of each filler bar 64, whereby the top surface or edge 46 of each deep bar is at substantially the same height as the bottom edge 98 and top surface 56C in the joined position. It is noted that the deep bars 28 of subassembly 26B are free of upwardly opening notches and in particular free of upwardly opening notches which receive therein a portion of crossbars 64. On the other hand, the deep bars 28 of subassembly 26A and the crossbars 64 of subassembly 62A (FIGS. 10 and 11) are each formed with the corresponding notches, and the deep bars 28 of lower subassembly 26 (FIG. 6) are formed with notches whereas the crossbars 64 of upper subassembly 62 are free of downwardly opening notches and in particular free of downwardly opening notches which receive therein a portion of the deep bars.

Grating system 10 thus provides a rigid grate suitable for supporting vehicle traffic such as cars and trucks while also accommodating pedestrian traffic without the concern of high heels, canes and wheels of wheelchairs becoming stuck between open spaces in the grating. Deep bars 28 and the perimeter wall 30 provide the primary structural strength for supporting heavy vehicles. However, these vehicles when moving over the grate system 10 will contact the top edges of crossbars 64 and top edges 96 of filler bars 68 whereby the weight of these vehicles is transferred via the crossbars and fillers bars directly to deep bars 28 and perimeter wall 30. In the exemplary embodiment, upper surface 14 of system 10 is formed entirely by the top edge 58 of outer perimeter wall 30, the top edges 78 of crossbars 64 and top edges 96 of filler bars 68. System 10 in the exemplary embodiment also provides a grating system in which no welds form any portion of top surface 14 although welds at the respective ends of the crossbars and filler bars may form a small portion of the upper surface of the grating system. However, in order to provide a clean appearance, it is preferred that system 10 is free of welds along its upper surface between any welds adjacent the ends of the crossbars or filler bars. In addition, it is preferred that upper subassembly 62 is free of welds which are used for joining its crossbars, filler bars, and joining bars to one another. The exemplary embodiment also provides a structure in which the upwardly opening notches 54 in deep bars are spaced downwardly from top surface 14 whereby system 10 is free of upwardly opening notches which communicate with top surface 14 for receiving therein one or more of various bars extending transverse to bars such as deep bars 28 in which notches are formed. This provides an advantage over grating systems which utilize such upwardly opening notches which communicate with the upper surface of the grating due in part to the resulting welds along the upper surface which would typically be used to secure crossbars in such notches. Even where such welds would not be used to secure crossbars in such notches, the elimination of these types of notches provides a cleaner, more aesthetically appealing upper surface of the grating. It is further noted that the embodiments shown in FIGS. 10-13 may include or be free of notches formed in the deep bars and/or crossbars while also providing the clean, aesthetically appealing upper surface of the grating along with substantial structural integrity.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A grating assembly having longitudinal and axial directions comprising:

a plurality of axially spaced longitudinal deep bars each having a top and bottom defining therebetween a first height;

a plurality of longitudinally spaced axial crossbars each having a top and bottom defining therebetween a second height less than the first height; and a plurality of longitudinally spaced axial filler bars each having a top and bottom defining therebetween a third height which is less than the second height;

wherein the deep bars are part of a first grating subassembly;

the crossbars and filler bars are part of a second grating subassembly;

the second subassembly has unjoined and joined positions in which it is respectively separate from and joined to the first subassembly;

the second subassembly is movable downwardly from the unjoined position to the joined position where it rests on top of the first subassembly;

the tops of the crossbars are substantially flush with the tops of the filler bars in the joined position; and a weld joins the first subassembly to the second subassembly in the joined position.

2. The grating assembly of claim 1 further comprising a plurality of axially spaced downwardly opening notches formed in each crossbar; and wherein each deep bar is disposed in one of the notches in each of the crossbars.

3. The grating assembly of claim 2 further comprising a plurality of longitudinally spaced upwardly opening notches formed in each deep bar; and wherein each of the crossbars is disposed in a plurality of the upwardly opening notches.

4. The grating assembly of claim 1 further comprising a plurality of longitudinally spaced upwardly opening notches formed in each deep bar; and wherein each of the crossbars is disposed in a plurality of the upwardly opening notches.

5. The grating assembly of claim 1 wherein each of the deep bars is formed entirely of metal.

6. The grating assembly of claim 1 wherein each of the crossbars is formed entirely of metal.

7. The grating assembly of claim 1 wherein each of the filler bars is formed of metal.

8. The grating assembly of claim 1 wherein each deep bar has first and second opposed ends and a top surface extending therebetween; and further comprising an axial end bar which is secured to the respective first ends of the deep bars; and a top surface of the end bar which is higher than the top surfaces of the deep bars and substantially flush with the tops of the filler bars.

9. The grating assembly of claim 1 wherein the plurality of deep bars comprises first, second and third deep bars; the second deep bar is between the first and third deep bars; and each crossbar has a first end disposed axially beyond the first deep bar in a first direction away from the second and third deep bars and a second end disposed axially beyond the third deep bar in a second opposed direction away from the first and second deep bars so that each crossbar extends continuously from the first end thereof to the second end thereof.

10. The grating assembly of claim 1 wherein the plurality of deep bars comprises first, second and third deep bars; the second deep bar is between the first and third deep bars; and each filler bar has a first end disposed axially beyond the first deep bar in a first direction away from the second and third deep bars and a second end disposed axially beyond the third deep bar in a second opposed direction away from the first and second deep bars so that each filler bar extends continuously from the first end thereof to the second end thereof.

11. The grating assembly of claim 1 further comprising a plurality of longitudinal joining bars joined to the crossbars and filler bars.

12. The grating assembly of claim 11 wherein the crossbars comprise first, second and third crossbars; the second crossbar is between the first and third crossbars; each joining bar has first and second opposed ends and extends continuously from the first end to the second end; the first end of each joining bar is disposed longitudinally beyond the first crossbar in a first direction away from the second and third crossbars; and the second end of each joining bar is disposed longitudinally beyond the third crossbar in a second opposed direction away from the first and second crossbars.

13. The grating assembly of claim 11 further comprising a first set of aligned holes formed through the crossbars and filler bars including one hole formed through three of the crossbars;

a second set of aligned holes formed through the crossbars and filler bars including one hole formed through three of the crossbars;

a first one of the joining bars extending through the first set of holes; and a second one of the joining bars extending through the second set of holes.

14. The grating assembly of claim 11 wherein each deep bar has first and second opposed ends and a top surface extending therebetween; and further comprising a first axial end bar which is secured to the respective first ends of the deep bars;

a top surface of the end bar which is higher than the top surfaces of the deep bars and substantially flush with the top surfaces of the filler bars;

a second axial end bar which is secured to the respective second ends of the deep bars;

a top surface of the second end bar which is higher than the top surfaces of the deep bars and substantially flush with the top surfaces of the filler bars; and wherein each joining bar extends continuously from adjacent the first axial end bar to adjacent the second axial end bar.

15. The grating assembly of claim 11 wherein each joining bar has a top and bottom defining therebetween a fourth height less than the third height.

16. The grating assembly of claim 15 wherein the joining bars are formed of metal.

17. The grating assembly of claim 11 wherein each joining bar has a top lower than the tops of the crossbars and filler bars.

18. The grating assembly of claim 11 wherein the joining bars are formed entirely of metal.

19. A grating assembly having longitudinal and axial directions comprising:

first, second and third axially spaced longitudinal deep bars each having a top and bottom defining therebetween a first height; wherein the second deep bar is between the first and third deep bars;

a plurality of longitudinally spaced axial crossbars each seated on the deep bars and each having a top and bottom defining therebetween a second height less than the first height; wherein each crossbar has a first end disposed axially beyond the first deep bar in a first direction away from the second and third deep bars and a second end disposed axially beyond the third deep bar in a second opposed direction away from the first and second deep bars so that each crossbar extends continuously from the first end thereof to the second end thereof; and a plurality of longitudinally spaced axial filler bars each having a top and bottom defining therebetween a third height which is less than the second height;

wherein the tops of the crossbars are substantially flush with the tops of the filler bars.

20. A grating assembly having longitudinal and axial directions comprising:

first, second and third axially spaced longitudinal deep bars each having a top and bottom defining therebetween a first height; wherein the second deep bar is between the first and third deep bars;

a plurality of longitudinally spaced axial crossbars each seated on the deep bars and each having a top and bottom defining therebetween a second height less than the first height; and a plurality of longitudinally spaced axial filler bars each having a top and bottom defining therebetween a third height which is less than the second height; wherein each filler bar has a first end disposed axially beyond the first deep bar in a first direction away from the second and third deep bars and a second end disposed axially beyond the third deep bar in a second opposed direction away from the first and second deep bars so that each filler bar extends continuously from the first end thereof to the second end thereof; and the tops of the crossbars are substantially flush with the tops of the filler bars.

* * * * *